US011369151B2

(12) United States Patent
Forell

(10) Patent No.: US 11,369,151 B2
(45) Date of Patent: Jun. 28, 2022

(54) WEIGHT LIFTING SUPPORT SHIRT

(71) Applicant: Robert Allen Forell, Lucinda, PA (US)

(72) Inventor: Robert Allen Forell, Lucinda, PA (US)

( * ) Notice: Subject to any disclaimer, the term of this patent is extended or adjusted under 35 U.S.C. 154(b) by 96 days.

(21) Appl. No.: 16/801,170

(22) Filed: Feb. 26, 2020

(65) Prior Publication Data

US 2021/0219633 A1 Jul. 22, 2021

Related U.S. Application Data

(60) Provisional application No. 62/963,543, filed on Jan. 21, 2020.

(51) Int. Cl.

| | |
|---|---|
| ***A41D 13/00*** | (2006.01) |
| ***A63B 21/00*** | (2006.01) |
| ***A63B 21/055*** | (2006.01) |
| ***A41D 27/10*** | (2006.01) |
| ***A63B 21/078*** | (2006.01) |

(52) U.S. Cl.

CPC ..... *A41D 13/0015* (2013.01); *A63B 21/0552* (2013.01); *A63B 21/4017* (2015.10); *A63B 21/4025* (2015.10); *A41D 13/00* (2013.01); *A41D 13/0002* (2013.01); *A41D 27/10* (2013.01); *A63B 21/078* (2013.01)

(58) Field of Classification Search

CPC ..... A63B 21/078; A63B 21/4025; A63B 71/1225; A41D 13/0015; A41D 13/0525; A41D 27/10

USPC ... 2/115, 92, 48, 44, 45, 459, 461, 463, 464, 2/467

See application file for complete search history.

(56) References Cited

U.S. PATENT DOCUMENTS 4,273,328 A 6/1981 Ozbey et al.
4,697,285 A * 10/1987 Sylvester ..... F41H 1/02 2/2.5
5,373,582 A * 12/1994 Dragone ..... F41H 1/02 2/102

(Continued)

OTHER PUBLICATIONS

"How to sew an X box". Published Jul. 25, 2019. Accessed via sew4home.com on Aug. 25, 2021. https://sew4home.com/sew-an-x-box-to-secure-straps-more/ (Year: 2019).*

(Continued)

*Primary Examiner* — Jameson D Collier
*Assistant Examiner* — Matthew R Marchewka
(74) *Attorney, Agent, or Firm* — Ashok Tankha

(57) ABSTRACT

A weight lifting support shirt is used to assist a lifter to perform workouts and includes a chest support portion, a shoulder support portion, an abdominal support portion, and a first and second arm support portions each including a sleeve portion. The chest support portion is configured to extend across a chest portion of the lifter from a first end to a second end. The first and second arm support portions extend from the first and second ends of the chest support portion, respectively. The shoulder support portion abuts and extends across boundaries of the first and second arm support portions, and the chest support portion. The first and second arm support portions are configured to conform around a first and a second arm of the lifter. The abdominal support portion extends below from the chest support portion and is configured to conform and fasten around the lifer's abdomen.

11 Claims, 9 Drawing Sheets

(56) References Cited

U.S. PATENT DOCUMENTS

| | | | | |
|---|---|---|---|---|
| 5,383,235 | A | 1/1995 | Peters | |
| 5,937,442 | A * | 8/1999 | Yamaguchi | A41D 31/185 2/69 |
| 8,578,517 | B2 | 11/2013 | Alaniz et al. | |
| 8,771,155 | B1 * | 7/2014 | Bell | A63B 21/4017 482/124 |
| 10,363,452 | B2 | 7/2019 | Alaniz | |
| 10,405,589 | B1 * | 9/2019 | Womack | A63B 21/4025 |
| 2010/0011490 | A1 * | 1/2010 | Stinson | A41D 13/0007 2/456 |
| 2010/0077527 | A1 | 4/2010 | Lee et al. | |
| 2015/0157068 | A1 * | 6/2015 | Puni | A41D 13/0512 2/44 |
| 2015/0196072 | A1 | 7/2015 | Inzer | |
| 2016/0050995 | A1 * | 2/2016 | Bentley | A41D 27/201 2/114 |
| 2017/0027240 | A1 * | 2/2017 | McClean | A41D 1/08 |
| 2018/0263303 | A1 * | 9/2018 | Alaniz, III | A63B 21/0552 |
| 2019/0343690 | A1 * | 11/2019 | Ishida | A41D 13/0015 |

OTHER PUBLICATIONS

"First glance at Metal Jack bench shirt". Published Jun. 20, 2011. Accessed via Youtube.com on Aug. 25, 2021. https://www.youtube.com/watch?v=e8THtmSCYJg (Year: 2011).*

* cited by examiner

WEIGHT LIFTING SUPPORT SHIRT

CROSS-REFERENCE TO RELATED APPLICATIONS

This application claims priority to and the benefit of the provisional patent application titled "Weight Lifting Support Shirt", application No. 62/963,543, filed in the United States Patent and Trademark Office on Jan. 21, 2020. The specification of the above referenced patent application is incorporated herein by reference in its entirety.

BACKGROUND

Physical exercise promotes health and well-being. Different physical activities are used for exercising, for example, cycling, running, outdoor sports, dancing, cross fit workouts, martial arts, gym-based workouts, weight lifting, etc. In general, gym-based workouts are generally a preferred workout because such workouts allow a person to exercise more parts of his body in a given period of time, build muscles, burn more calories, etc. As used herein, a barbell is an exercise equipment used in weight training, bodybuilding, weightlifting and powerlifting, consisting of a long bar, usually with weights attached at each end. Bench press of a barbell is a workout which is targeted for the development of the upper torso, arms and shoulders. However, workouts such as weight lifting performed by a weight lifter, hereafter lifter, in the gym requires careful attention regarding the workout method, and the body movements associated with such workouts.

During a bench press when a barbell is lifted by a lifter, there is significant increase in strain and pressure on the lifter's rotator cuffs, especially if the lifter is not following a proper bar path recommended for a bench press exercise. For example, the lifter should raise and lower the barbell used in the bench press along a substantially straight path, and substantially perpendicular to the bench. When the lifter follows an incorrect path for lifting and lowering the barbell, the weight of the barbell generally concentrates on the rotator cuffs which is harmful for the shoulder. The shoulder girdle needs to be stabilized during such bench press workouts to avoid injuries to the shoulder area. There are no existing workout shirts, or bench shirts, to reduce or redirect this concentration of weight on the rotator cuffs of the lifter.

Furthermore, prior art bench shirts do not allow the lifter to follow a proper bar path when bench pressing, which is a substantially straight path, and substantially perpendicular to the ground. Furthermore, prior art bench shirts opt for narrower arm sleeve angles and looser chest regions that requires the lifter to adopt an uncomfortable and compromising grip on the barbell while working out. The lifter is often restricted to the point where the lifter is unable to grip the barbell at the proper position by themselves, and need the assistance of a spotter to stretch the lifter's arms out to the sides to allow lifter to grip the barbell at the proper position.

Therefore, there is a need for a bench press shirt that will provide the necessary flexibility to the lifter to allow a proper range of motion and depth of the barbell, while transferring the load and energy of the barbell to the center of the bench press shirt when the barbell is lowered by the lifter. There is also a need for a bench press shirt to maximize transfer of the load and energy of the barbell from the shoulders to the triceps, pectoral, and latissimus region of the lifter, to reduce strain on the rotator cuffs and stabilize the shoulder and shoulder girdle of the lifter while the bench press workout is performed.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The weight lifting support shirt disclosed herein addresses the need for a bench press shirt that will provide the necessary flexibility to the lifter to allow a proper range of motion and depth of the barbell, while transferring the load and energy of the barbell to the center of the bench press shirt during the lowering of the barbell. The bench press shirt maximizes transfer of the load and energy of the barbell from the shoulders to the triceps, pectoral, and latissimus region of the lifter, to reduce strain on the rotator cuffs and stabilize the shoulder and shoulder girdle of the lifter while the bench press workout is performed.

The weight lifting support shirt comprises a chest support portion, a first arm support portion, a second arm support portion, a shoulder support portion, a sleeve portion in each of the first and second arm support portions, and an abdominal support portion. The chest support portion is configured to extend across a chest portion of the lifter from a first end to a second end of the chest support portion. The first arm support portion extends from the first end of the chest support portion, and the second arm support portion extends from the second end of the chest support portion. The first and second arm support portions are configured to conform around a first arm and a second arm of the lifter. The shoulder support portion abuts and extends across boundaries of the first arm support portion, the second arm support portion, and the chest support portion. The shoulder support portion is configured to transfer weight from a shoulder portion of the lifter to the triceps, pectoral and latissimus region of the lifter. In an embodiment, the sleeve portions are configured to require the lifter to lift and lower the barbell during the workouts along a substantially straight path and substantially perpendicular to the bench. The abdominal support portion is in communication with and extends below the chest support portion; the abdominal support portion is configured to conform and fasten around the abdomen of the lifter.

In an embodiment, the weight lifting support shirt further comprises a grid plate positioned at about the center of the chest support portion. The grid plate is configured to prevent an extension of the material of the weight lifting support shirt and to direct the rebound energy released during the workout into the chest portion and the arms of the lifter. In an embodiment, the abdominal support portion is fastened to the abdomen using a hook and loop fastener, for example, VELCRO™. In an embodiment, the abdominal support portion comprises a first lateral extension comprising a hook component of the hook and loop fastener, and a second lateral extension comprising a loop component of the hook and loop fastener. In an embodiment, the weight lifting support shirt aligns the hands of the lifter to move along a predetermined bar path. In an embodiment, the predetermined bar path confirms to the optimum bar path utilized in a bench press exercise.

The sleeve portions are in communication with and attached to the shoulder support portion and the chest support portion of the lifter at an angle configured to require the lifter to move a barbell along a substantially straight path, and substantially perpendicular to the bench during a bench press. In an embodiment, the weight lifting support shirt further comprises triple-ply elastic arm bands that are attached to a shoulder support portion of the weight lifting support shirt. The triple-ply elastic arm bands are configured to transfer the weight exerted on the shoulder portion into the triceps, pectoral and latissimus region of the lifter, to reduce strain on the rotator cuffs of the lifter. In an embodiment, the shoulder support portion comprises an elastic layer that provides flexibility to the lifter for a predefined range of motion and depth during a barbell weight lifting exercise.

In an embodiment, the shoulder support portion transfers weight and energy of the barbell to the center of the weight lifting support shirt during the descent of the barbell. In an embodiment, the center of the chest support portion is reinforced with figure eight stitching, which further concentrates the load and energy received from multiple angles during the workout to the center of the weight lifting support shirt. In an embodiment, when the lifter lowers the barbell and stretches the elastic material of the weight lifting support shirt, the energy received and concentrated at the center of the weight lifting support shirt is conserved until the lifter presses the barbell away from the body, at which point the concentrated energy rebounds through the chest portion and triceps, pectoral and latissimus region of the lifter.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1A:
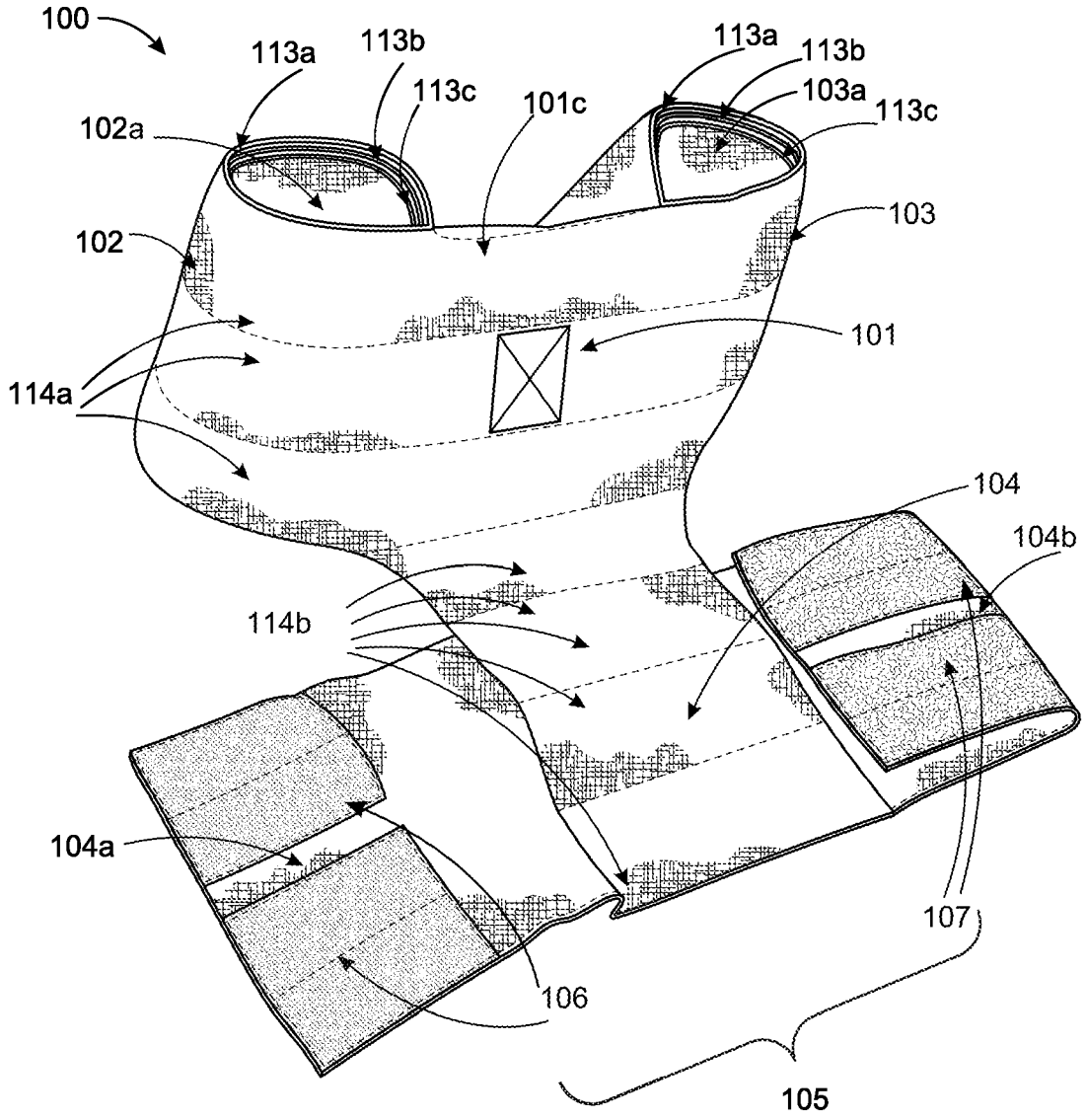
FIG. 1A exemplarily illustrates a front perspective view of the weight lifting support shirt.
Figure 1B:
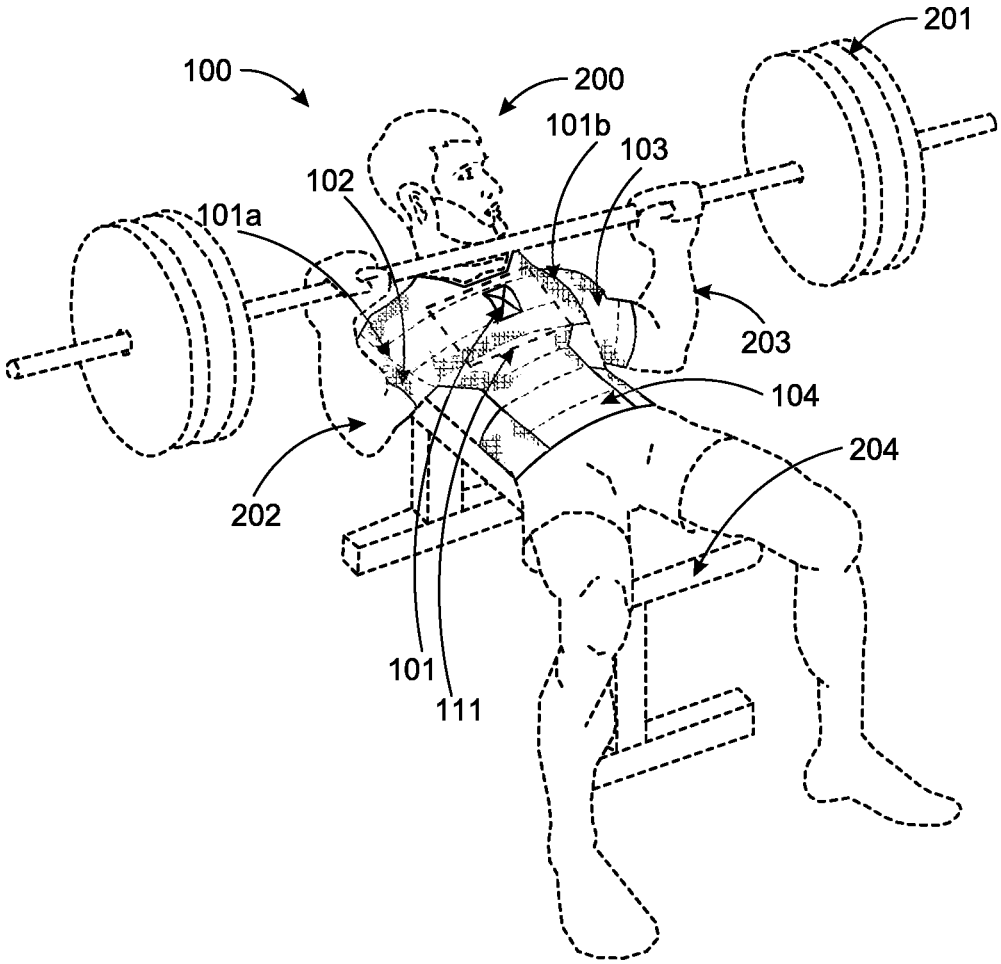
FIG. 1B exemplarily illustrates a perspective view of the weight lifting support shirt that is being used by a lifter during a bench press workout.

FIG. 1A exemplarily illustrates a front perspective view of the weight lifting support shirt 100, and FIG. 1B exemplarily illustrates a perspective view of the weight lifting support shirt 100 used by a lifter 200 during a bench press workout. The weight lifting support shirt 100 is a wearable device that provides the weight lifter 200 flexibility of movement in any direction during a barbell exercise, while allowing the transfer of the load and energy of the barbell 201 to the center of the weight lifting support shirt 100 and maximizing transfer of the load and energy of the barbell from the shoulders to the triceps, pectoral, and latissimus region of the lifter 200, to reduce strain on the rotator cuffs and stabilize the shoulder and shoulder girdle of the lifter 200. The weight lifting support shirt 100 provides support to the lifter 200 during a variety of workouts, for example, a bench press as shown in FIG. 1B. The weight lifting support shirt 100 comprises a chest support portion 101, a first arm support portion 102 a second arm support portion 103, a shoulder support portion 108*a*, a sleeve portion 102*a* in the first arm support portion 102, a sleeve portion 103*a* in the second arm support portion 103, and an abdominal support portion 104.

Figure 2A:
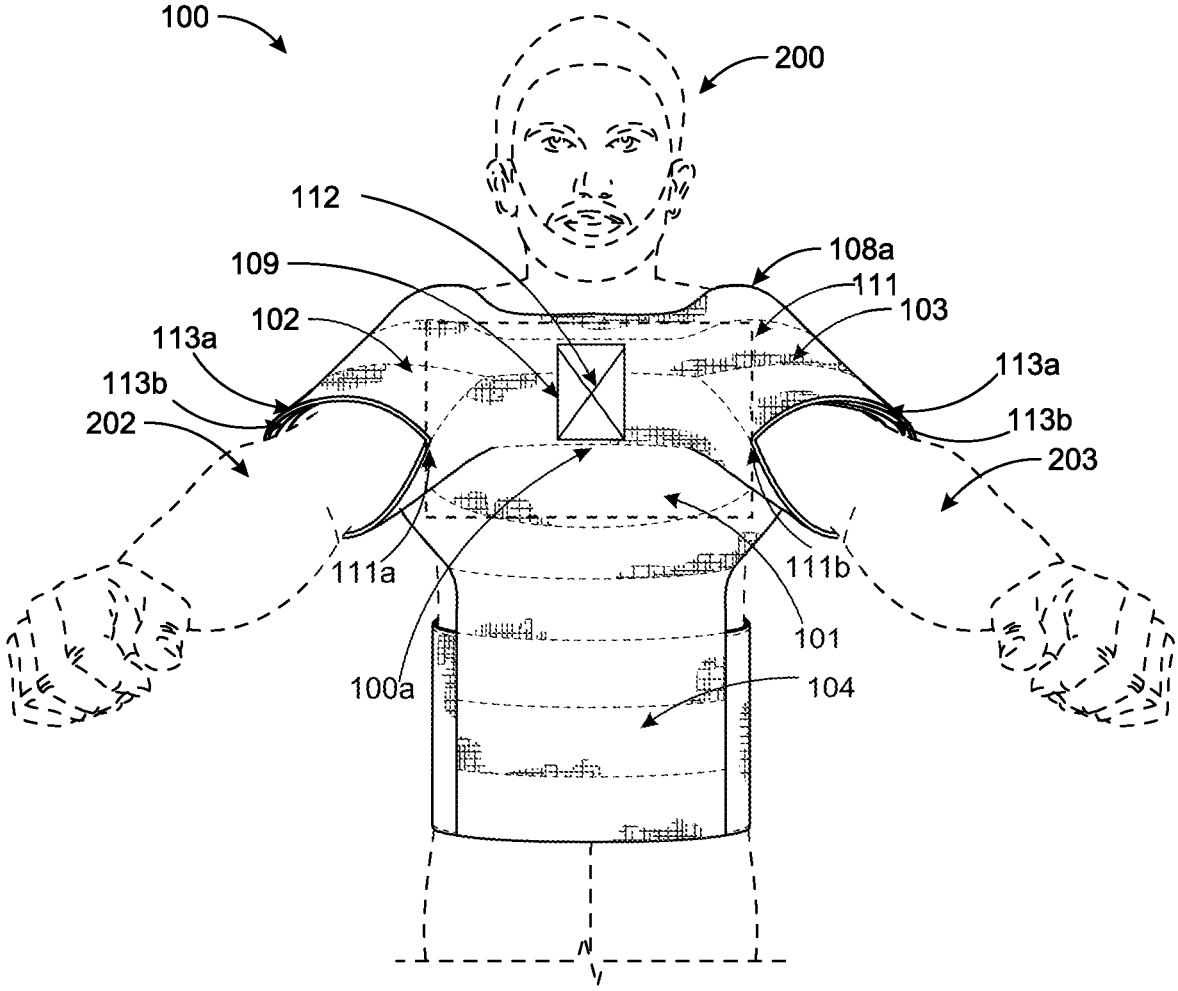
FIG. 2A illustrates a front perspective view of the weight lifting support shirt worn by the lifter.
Figure 2B:
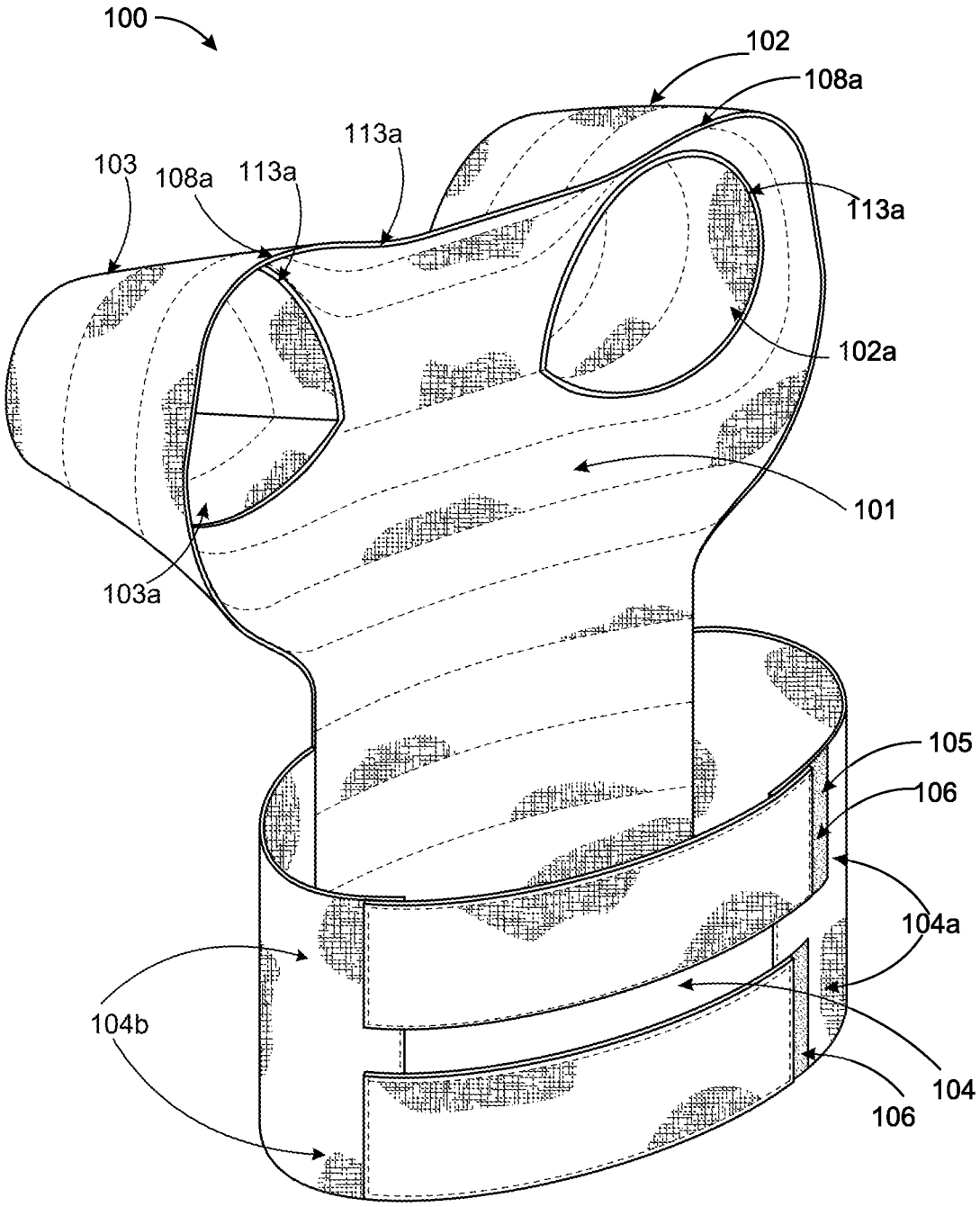
FIG. 2B illustrates a rear perspective view of the weight lifting support shirt.

The chest support portion 101 of the weight lifting support shirt 100 extends across the chest portion 111 of the lifter 200 from a first end 111*a* to a second end 111*b* of the chest portion 111, as illustrated in FIG. 2A. The first arm support portion 102 extends from the first end 111*a* of the chest support portion 111 and the second arm support portion 103 extends from the second end 111*b* of the chest portion 111. The first and second arm support portions 102 and 103 are configured to conform around a first arm 202 and a second arm 203 of the lifter 200, as shown in FIG. 1B. The shoulder support portion 108*a* abuts and extends across boundaries of the first arm support portion 102, the second arm support portion 103, and the chest support portion. 101, as illustrated in FIGS. 2A, 2B, 2C, 2D and 3A. The shoulder support portion 108*a* is configured to transfer weight from a shoulder portion 108 of the lifter 200 into the triceps, pectoral and latissimus region of the lifter 200. The sleeve portions 102*b* and 103*a* are configured to require the lifter to lift the barbell 201 and lower the barbell 201 in a workout along a substantially straight path and substantially perpendicular to the bench 204. The abdominal support portion 104 is in communication with and extends below the chest support portion 101. The abdominal support portion 104 is configured to conform and fasten around abdomen of the lifter 200. Furthermore, a neck relief portion 101*c* is in communication with and extends from the chest support portion 101 to provide support to the neck of the lifter 200 during the bench press lifting process. In an embodiment, the weight lifting support shirt 100 is made of varying layers of competition-grade elastic material. In an embodiment, the sleeve portions 102*a* and 103*a* comprise arm bands that are made of triple-ply competition-grade elastic material 113*a*, 113*b* and 113*c*, as illustrated in FIGS. 1A, 2A, and 2B.

In an embodiment, the abdominal support portion 104 is fastened around the abdomen of the lifter, using, for example, a hook and loop fastener 105. The abdominal support portion 104 comprises a first lateral extension 104*a* and a second lateral extension 104*b*. The first lateral extension 104*a* and a second lateral extension 104*b* are attached to the abdominal support portion 104. In an embodiment, the first lateral extension 104*a* and a second lateral extension 104*b* are attached to the lateral sides of the abdominal support portion 104 by stitching. The hook and loop fastener 105 comprises a hook component 106 and a loop component 107. The hook component 106 is positioned on first lateral extension 104*a* and the loop component 107 is positioned on second lateral extension 104*b*. The hook component 106 of the hook and loop fastener 105 comprises one or more fabric strips with small hooks with hook ends sewn on front of the first lateral extension 104*a*. The loop component 107 of the hook and loop fastener 105 comprises one or more fabric strips with small loops with the loop ends sewn on the back of the second lateral extension 104*b*. The hook and loop fastener 105 is, for example, VELCRO™ manufactured by VELCRO® BVBA of United Kingdom.

The first lateral extension 104*a* and the second lateral extension 104*b* are made of an elastic material, for example, spandex, and the hook and loop fastener 105 is sewn over the elastic material. The weight lifting support shirt comprising the chest support portion 101, the first arm support portion 102, the second arm support portion 103, the shoulder support portion 108*a*, the sleeve portions 102*a* and 103*a*, and the abdominal support portion 104, and the first and second lateral extensions and 104*a* and 104*b* are made of an elastomer. As used herein, an elastomer is any material that exhibits elastic properties. Examples of elastomers comprise natural rubber, synthetic rubber, nitrile rubber, silicone rubber, urethane rubbers, chloroprene rubber, ethylene vinyl acetate (EVA rubber), etc. In another embodiment, the weight lifting support shirt 100, excluding the first and second lateral extensions and 104*a* and 104*b*, is made of a composite material comprising an elastic material lined with a natural fabric, for example, cotton. In an embodiment, the natural fabric lining is provided on portions of the weight lifting support shirt 100 that contact the body of the lifter 200.

Figure 2C:
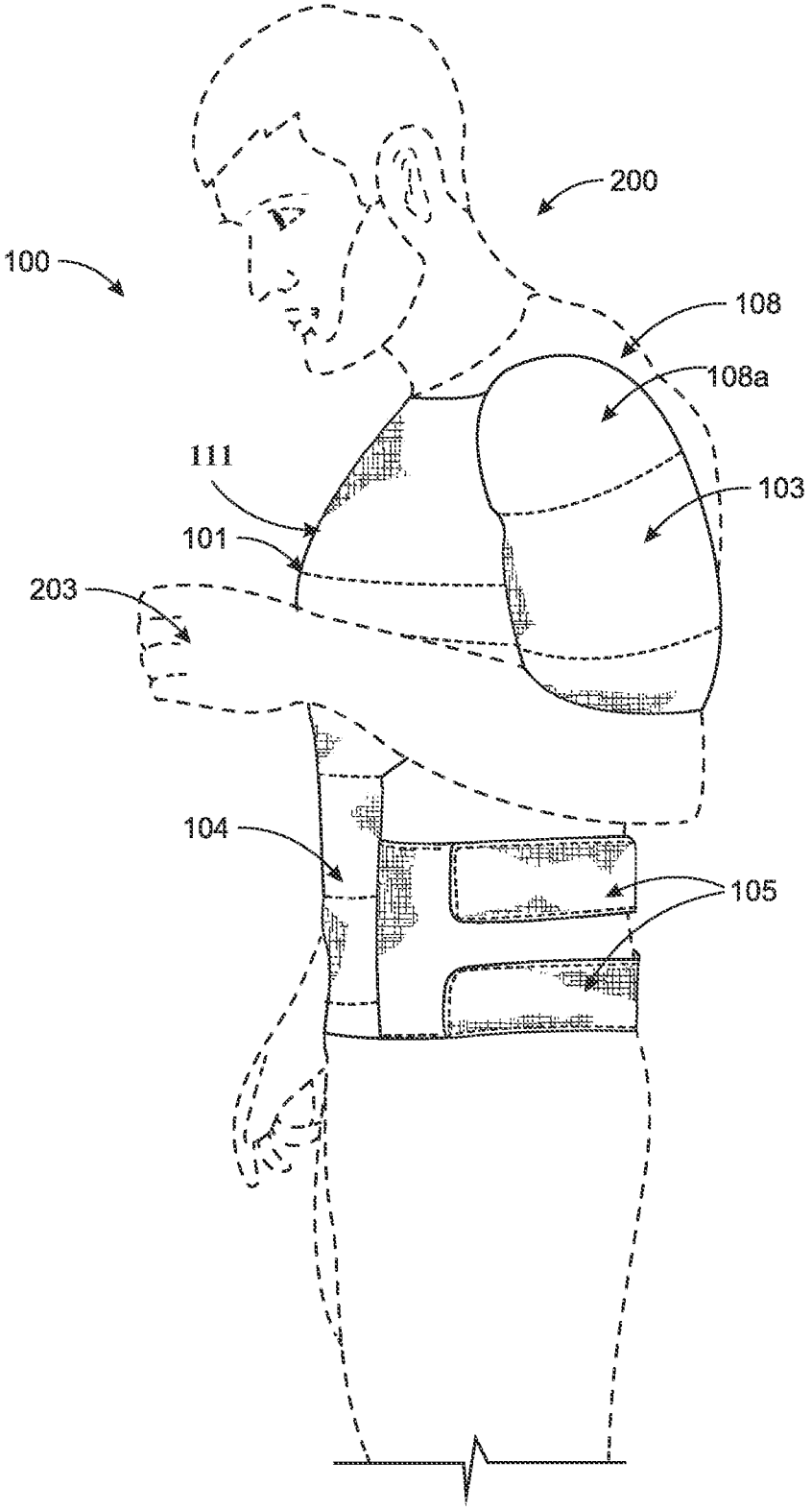
FIG. 2C illustrates a left-side perspective view of the weight lifting support shirt that's worn by the lifter.
Figure 2D:
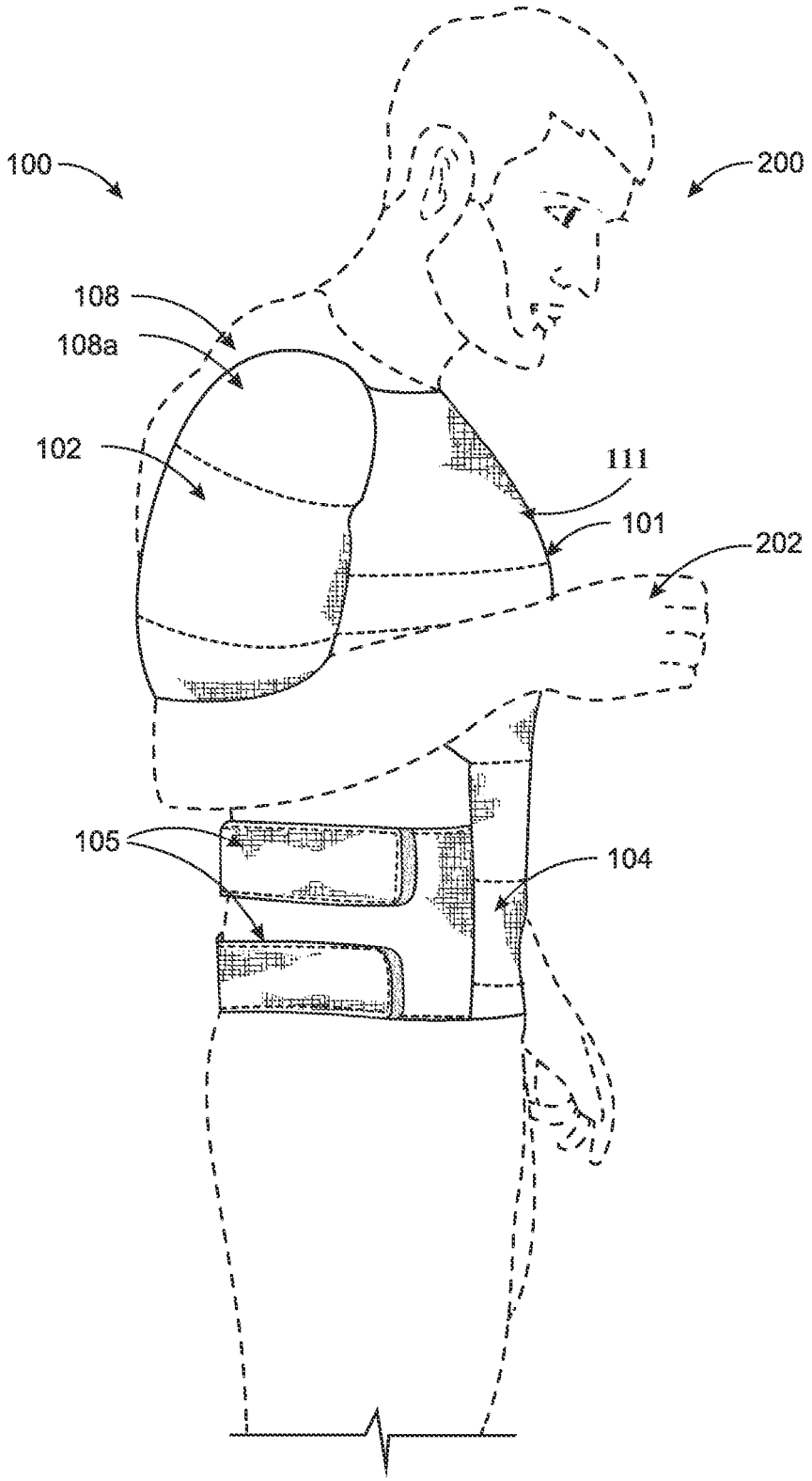
FIG. 2D illustrates a right-side perspective view of the weight lifting support shirt worn by the lifter.

In an embodiment, the chest support portion 101 and the abdominal support portion 104 of the weight lifting support shirt 100 wrap around the chest portion 111 and the abdomen of the lifter 200, respectively. The abdominal support portion 104 is secured at the back of the lifter 200 using the hook and loop fastener 105, as illustrated in FIGS. 2B, 2C, and 2D. As illustrated in FIG. 1A, the lifter 200 draws together the first lateral extension 104*a* and the second lateral extension 104*b* behind the abdomen of the lifter to align the first lateral extension 104*a* and the second lateral extension 104*b*. Then, the first lateral extension 104*a* and/or the second lateral extension 104*b* are pulled to a desired level of tightness. The hook component 106 and loop component 107 on the first lateral extension 104*a* and the second lateral extensions 104*b*, respectively, are thereafter attached to each other to fasten the weight lifting support shirt 100 around the abdomen of the lifter 200.

Figure 3A:
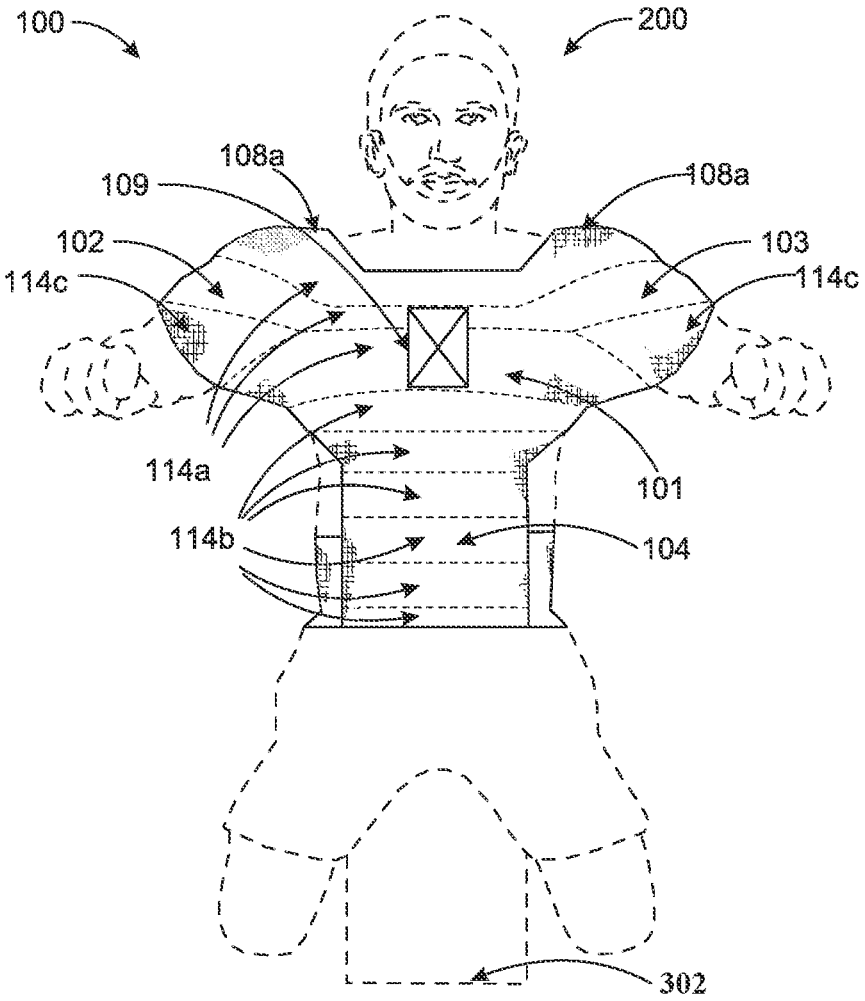
FIG. 3A illustrates a top perspective view of lifter using the weight lifting support shirt during the bench press workout.
Figure 3B:
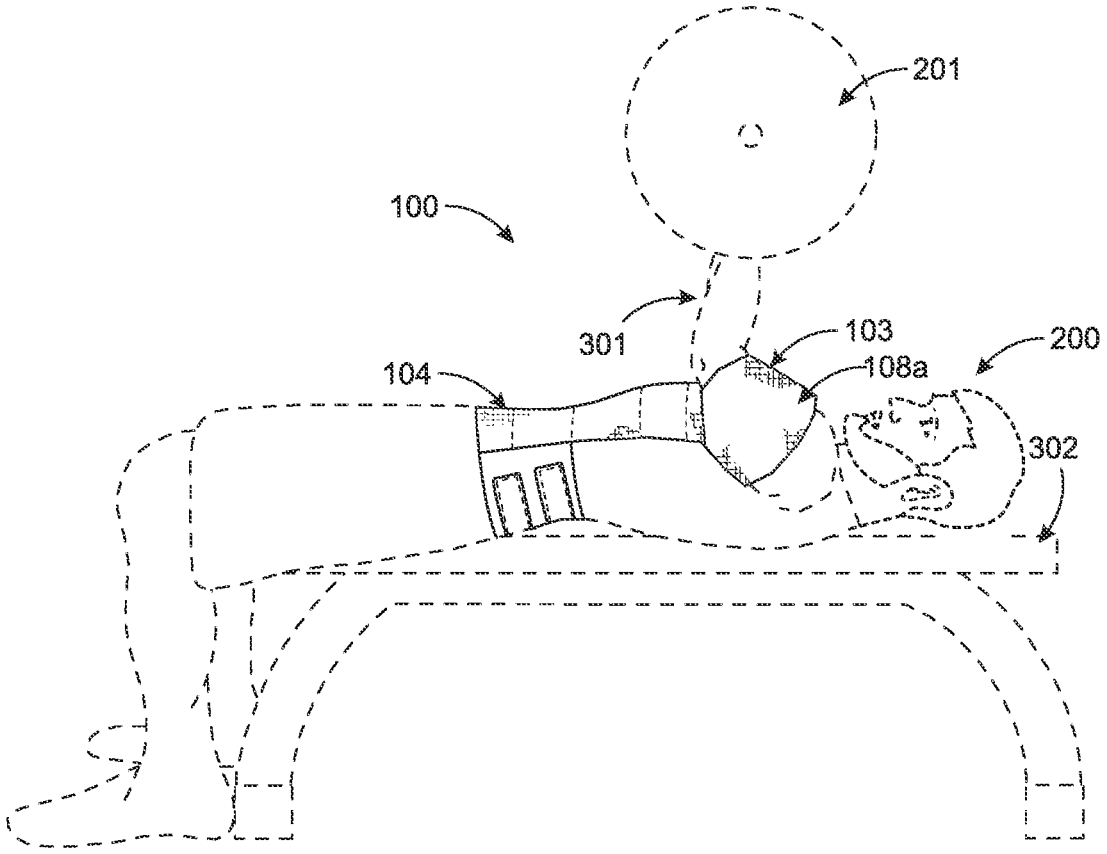
FIG. 3B illustrates a side perspective view of lifter using the weight lifting support shirt during the bench press workout.

FIGS. 2A-2D illustrate perspective views of the weight lifting support shirt 100 that is worn by the lifter 200, where FIG. 2B illustrates a rear perspective view of the weight lifting support shirt 100 without the lifter 200 in the perspective view. The weight lifting support shirt 100 assists a lifter 200 during the bench press exercise. As shown in FIGS. 1B and 3B, in a bench press, the lifter lays on a bench 204 and secures the barbell 201 with the lifter's 200 arms 202 and 203 that project through the front of the weight lifting support shirt 100. The lifter 200 thereafter lifts the barbell 201 and lowers the barbell 201 to complete one cycle of the lifting cycle. During such barbell lifting and lowering cycles, as shown in FIGS. 1B and 3B, the sleeve portions 102*a* and 103*a* of the arm portions 102 and 103, shoulder support portion 108*a*, and the chest support portion 101 allow the lifter 200 to move the barbell 201 in a substantially straight path and substantially perpendicular to the bench 204, thereby reducing the barbell 201 load and pressure from the shoulders to the triceps, pectoral, and latissimus region of the lifter 200, which in turn reduces the strain on the lifter's rotator cuffs.

As illustrated in FIG. 2A, in an embodiment, the shoulder support portion 108*a* of the weight lifting support shirt 100 comprises one or more elastic layers 113*a* that provides flexibility and range of motion in any direction to the lifter 200 when the lifter 200 raises and lowers a barbell 201, and also transfers the barbell 201 load to the center 100*a* of the weight lifting support shirt 100 when the barbell 201 is lowered by the lifter 200. Furthermore, when the barbell 201 is lowered by the lifter 200, the elastic arm bands attached to the shoulder support portion 108*a* of the weight lifting support shirt 100 transfer the weight of the barbell 201 from the shoulder portion 108 of the lifter to the triceps, pectoral, and latissimus region of the lifter 200 which reduces strain on the rotator cuffs of the lifter 200, and the grid plate 109 positioned at the center of the chest support portion 101 of the weight lifting support shirt 100 transfers the barbell weight towards the center of the chest of the lifter 200, which is further explained in the description of FIGS. 3A-3C.

The shoulder support portion 108*a* and the first and second arm support portions 102 and 103 are in communication with and attached to the chest support portion 101. The abdominal support portion 104 is also in communication with and attached to the chest support portion 101. In an embodiment, the shoulder support portion 108*a*, the first and second arm support portions 102 and 103, and the abdominal support portion 104 are attached to the chest support portion 101 by stitching together portions of the elastic material that form the shoulder support portion 108*a*, the first and second arm support portions 102 and 103, the chest support portion 101, and the abdominal support portion 104. In another embodiment, lateral sides of a plurality of elastic strips 114*a* are stitched together, as illustrated by dotted lines in FIGS. 1A and 3A, to form the shoulder support portion 108*a*, the first and second arm support portions 102 and 103, and the chest support portion 101. In this embodiment, the abdominal support portion 104 is also made of a plurality of elastic strips 114*b* stitched together on their lateral sides, and the abdominal support portion 104 is then attached to the chest support portion 101. The first and second arm support portions 102 and 103 comprise additional elastic strips 114*c*, as illustrated in FIG. 3A, stitched together with elastic strips 114*a* that form the first and second arm support portions 102 and 103. In an embodiment, the shoulder support portion 108*a*, the first and second arm support portions 102 and 103 are detachably connected to the chest support portion 101.

Figure 3C:
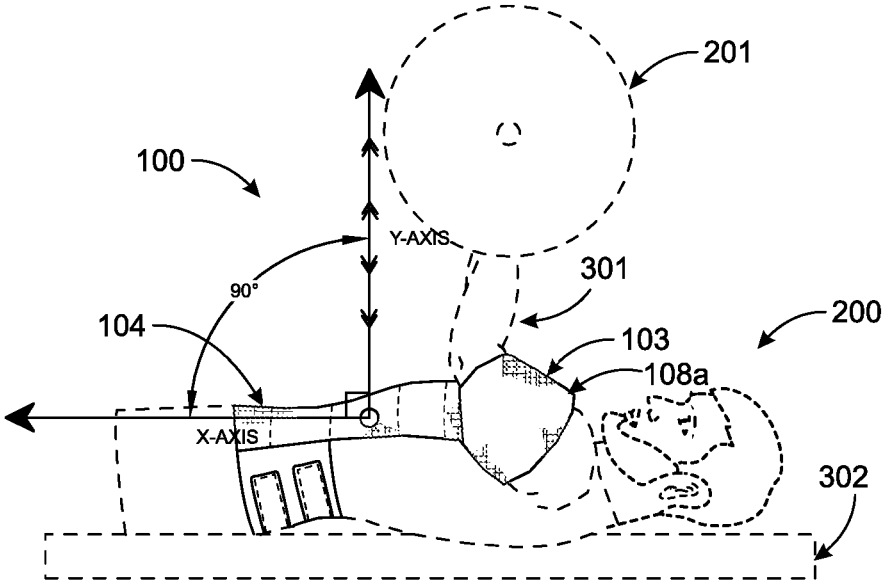
FIG. 3C illustrates a detailed side perspective view of a lifter using the weight lifting support shirt during the bench press workout.

FIGS. 3A-3C illustrate perspective views of a lifter 200 using the weight lifting support shirt 100 during the bench press workout. The weight lifting support shirt 100 trains the lifter 200 to adopt the proper barbell 201 path in the bench press workout, namely, lowering the barbell 201 to the lifter's chest 111 and returning the barbell 201 to the fully extended/rack position 301 substantially in a straight path and substantially perpendicular to the bench 302, as shown in FIG. 3C. Following a substantially straight path, substantially perpendicular to the bench 302 for lifting and lowering the barbell 201 engages the latissimus, pectoral, and triceps muscles, thereby reducing pressure and strain on the rotator cuffs of the lifter 200. The weight lifting support shirt 100 further comprises a grid plate 109 that is positioned at the center of the chest support portion 101, which is configured to prevent stretching of the material of the weight lifting support shirt 100, and to direct the rebound, released energy during the workout into the chest portion 111 and the arms of the lifter 200.

The sleeves portions 102*a* and 103*a* are in communication with and connected to the shoulder support portion 108*a* and chest support portion 101 at an angle that requires the lifter 200 to move the barbell 201 in a substantially straight path, and substantially perpendicular to the bench 302, as shown in FIGS. 3B and 3C. In an embodiment, the shoulder support portion 108*a* and/or the arm support portions 102 and 103 of the weight lifting support shirt 100 illustrated in FIG. 2B comprises at least one elastic material 113*a* to provide the necessary flexibility and proper range of motion of the lifter's arm in any direction when the barbell 201 is raised and lowered, and for transferring the barbell's load and energy towards the center 100*a* of the weight lifting support shirt 100 when the barbell 201 is lowered. In an embodiment, the shoulder support portion 108*a* and/or the arm support portions 102 and 103 of the weight lifting support shirt 100 illustrated in FIG. 2A comprises at least two elastic layers 113*a* and 113*b*. In another embodiment, the shoulder support portion 108*a* and/or the arm support portions 102 and 103 of the weight lifting support shirt 100 illustrated in FIG. 1A comprises at least three elastic layers 113*a*, 113*b*, and 113*c*. As illustrated in FIGS. 1B and 3A, in an embodiment, the center of the chest support portion 101 is reinforced with the optimally-sized figure eight stitching, which maximizes the transfer of the load and energy received when the barbell is lifted and lowered towards the chest portion 111, triceps, pectoral, and latissimus region of the lifter 200. As the lifter 200 lowers the barbell 201 and stretches the elastic material of the weight lifting support shirt 100, the stretch energy is transferred to the center of the weight lifting support shirt 100 and conserved or stored there until the lifter 200 presses the barbell 201 away from the lifter 200, at which point the stretch energy rebounds back to the chest portion 111, triceps, pectoral, and latissimus region of the lifter 200.

The construction of the weight lifting support shirt 100 comprises an elastic support shirt 100 composition; the use of the weight lifting support shirt 100 holds and transfers more energy to the lifter than prior art shirts, thereby providing more stretch energy rebound to the lifter 200. Furthermore, the design of the weight lifting support shirt 100 requires the lifter 200 to use the proper barbell 201 path that is substantially along a straight path, substantially perpendicular to the bench 302, when bench pressing, as shown in FIG. 3C. These problems are addressed by the weight lifting support shirt 100 disclosed herein, which further comprises wider angles of the arm support portions 102 and 103 that are designed to be tighter at the middle of the weight lifting support shirt 100 via the optimally sized figure eight pattern grid plate 109, which allows the lifter 200 to get a comfortable and secure fit from the set-up of the weight lifting exercise and throughout the execution of the lift.

As disclosed above, due to the figure eight stitching design 112 in the grid plate 109 at the center of the chest of the weight lifting support shirt 100, the energy from the arms 202 and 203 and chest is stored in the center of the weight lifting support shirt 100 when the lifter 200 is lowering the barbell 201 down to the chest. This directs the weight lifting support shirt 100 to stretch until the grid plate 109 stops the lifter 200 from proceeding further, at which point the energy in the weight lifting support shirt is released and rebounds to the chest and arms 202 and 203 to assist the lifter 200 in pressing the barbell 201 back to the fully extended/locked out position.

The foregoing examples have been provided merely for explanation and are in no way to be construed as limiting of the weight lifting support shirt 100 disclosed herein. While the weight lifting support shirt 100 has been described with reference to various embodiments, it is understood that the words, which have been used herein, are words of description and illustration, rather than words of limitation. Furthermore, although the weight lifting support shirt 100 has been described herein with reference to particular means, materials, and embodiments, the weight lifting support shirt 100 are not intended to be limited to the particulars disclosed herein; rather, the weight lifting support shirt 100 extend to all functionally equivalent structures, methods and uses, such as are within the scope of the appended claims. While multiple embodiments are disclosed, it will be understood by those skilled in the art, having the benefit of the teachings of this specification, that weight lifting support shirt 100 disclosed herein are capable of modifications and other embodiments may be effected and changes may be made thereto, without departing from the scope and spirit of the weight lifting support shirt 100 disclosed herein.

I claim:

1. A weight lifting support shirt to allow a lifter to perform one or more workouts, the weight lifting support shirt comprising:

a chest support portion configured to extend across a chest portion of the lifter from a first end to a second end;

a first arm support portion extending from the first end of the chest support portion;

a second arm support portion extending from the second end of the chest support portion, wherein the first and second arm support portions are configured to conform around a first arm and a second arm of the lifter;

a shoulder support portion abutting and extending across boundaries of the first arm support portion, the second arm support portion, and the chest support portion;

each of the first arm support portion and the second arm support portion comprising a sleeve portion, wherein the sleeve portions are configured to enable the lifter to raise a barbell and lower the barbell during a bench press workout;

a figure eight stitching at a center of the chest support portion;

a grid plate disposed around the figure eight stitching at the center of the chest support portion; and an abdominal support portion in communication with and extending below the chest support portion;

wherein the weight lifting support shirt comprises an elastic material, wherein when the lifter lowers the barbell and stretches the elastic material of the weight lifting support shirt, load and energy received from the barbell is transferred to the center of the chest support portion and is stored in the grid plate disposed around the figure eight stitching, and wherein when the lifter lifts the barbell, load and energy stored in the grid plate disposed around the figure eight stitching rebounds and transfers to triceps, pectoral region, and latissimus region of the lifter, wherein a combination of the figure eight stitching and the grid plate disposed around the figure eight stitching enables performance of the bench press workout by the lifter in a proper bar path, and wherein the proper bar path for the bench press workout comprises a substantially straight path, substantially perpendicular to a ground surface.

2. The weight lifting support shirt of claim 1, wherein the abdominal support portion is configured to be fastened about an abdomen of the lifter using a hook and loop fastener.

3. The weight lifting support shirt of claim 2, wherein the abdominal support portion comprises a first lateral extension comprising a hook component of the hook and loop fastener and a second lateral extension comprising a loop component of the hook and loop fastener.

4. The weight lifting support shirt of claim 1, wherein the weight lifting support shirt is configured to align hands of the lifter to move in the substantially straight path, substantially perpendicular to the ground surface.

5. The weight lifting support shirt of claim 1, wherein an angle at which the sleeve portions connect to the shoulder support portion and the chest support portion of the lifter is configured to enable the lifter to move the barbell in the substantially straight path, substantially perpendicular to the ground surface.

6. The weight lifting support shirt of claim 1, wherein the sleeve portion comprises triple-ply elastic arm bands that are attached to the shoulder support portion of the weight lifting support shirt, and wherein the triple-ply elastic arm bands are configured to transfer the load and the energy from the shoulder portion of the lifter into the triceps, the pectoral region, and the latissimus region of the lifter to reduce strain on rotator cuffs of the lifter.

7. The weight lifting support shirt of claim 6, wherein the shoulder support portion comprises an elastic layer that provides flexibility to the lifter for a predefined range of motion and depth.

8. The weight lifting support shirt of claim 7, wherein the shoulder support portion is configured to transfer the load and the energy of the barbell into the center of the chest support portion during descent of the barbell.

9. The weight lifting support shirt of claim 8, wherein the figure eight stitching and grid plate disposed around the figure eight stitching are configured to concentrate the load and energy received from multiple angles during the bench press workout to the figure eight stitching and the grid plate disposed around the figure eight stitching at the center of the weight lifting support shirt.

10. The weight lifting support shirt of claim 1, wherein the grid plate is configured to prevent stretching of the elastic material of the weight lifting support shirt, and rebound the load and the energy stored in the grid plate disposed around the figure eight stitching into the chest portion and arms of the lifter during the bench press workout.

11. A weight lifting support shirt to allow a lifter to perform one or more workouts, the weight lifting support shirt comprising:

a chest support portion configured to extend across a chest portion of the lifter from a first end to a second end;

a first arm support portion extending from the first end of the chest support portion;

a second arm support portion extending from the second end of the chest support portion, wherein the first and second arm support portions are configured to conform around a first arm and a second arm of the lifter, respectively;

a shoulder support portion abutting and extending across boundaries of the first arm support portion, the second arm support portion, and the chest support portion;

each of the first arm support portion and the second arm support portion comprising a sleeve portion, wherein the sleeve portions are configured to enable the lifter to perform the one or more workouts;

a figure eight stitching at a center of the chest support portion;

a grid plate disposed around the figure eight stitching at the center of the chest support portion, wherein a combination of the figure eight stitching and the grid plate disposed around the figure eight stitching enables storing and rebounding of load and energy when the lifter performs the one or more workouts; and an abdominal support portion in communication with and extending below the chest support portion.

* * * * *